US011004438B2

(12) United States Patent
Giffin et al.

(10) Patent No.: US 11,004,438 B2
(45) Date of Patent: May 11, 2021

(54) UPFIRING SPEAKER SYSTEM WITH REDIRECTING BAFFLE

(71) Applicant: Vizio Inc., Irvine, CA (US)

(72) Inventors: Jason Giffin, Costa Mesa, CA (US); Ryan Tubman, Mission Viejo, CA (US)

(73) Assignee: Vizio, Inc., Irvine, CA (US)

( * ) Notice: Subject to any disclaimer, the term of this patent is extended or adjusted under 35 U.S.C. 154(b) by 504 days.

(21) Appl. No.: 15/960,789

(22) Filed: Apr. 24, 2018

(65) Prior Publication Data

US 2019/0325858 A1 Oct. 24, 2019

(51) Int. Cl.
*G10K 11/20* (2006.01)

(52) U.S. Cl.
CPC ..... *G10K 11/20* (2013.01)

(58) Field of Classification Search
CPC ..... G10K 11/20; G10K 11/28
USPC ..... 181/155
See application file for complete search history.

(56) References Cited

U.S. PATENT DOCUMENTS 5,532,438 A * 7/1996 Brown ..... H04R 1/32 181/155
5,646,378 A * 7/1997 Van Haaff ..... E04H 3/24 181/144
7,343,020 B2 * 3/2008 Thigpen ..... H04R 5/02 381/302
9,378,726 B2 * 6/2016 Melhart ..... G10K 11/20
10,241,740 B2 3/2019 Seefeldt et al.
10,241,746 B2 * 3/2019 Sheedy ..... B63B 49/00

FOREIGN PATENT DOCUMENTS

CA 2501162 A1 * 4/2004 ..... H04R 1/345
DE 102011107312 A1 * 3/2013 ..... H04R 1/345
JP 2009092682 A * 4/2009
KR 101290695 B1 * 7/2013
WO 2014036085 A1 3/2014
WO 2017030914 A1 2/2017

* cited by examiner

*Primary Examiner* — Forrest M Phillips
(74) *Attorney, Agent, or Firm* — Hansen IP Law PLLC

(57) ABSTRACT

A sound system with upfiring speakers and a redirecting baffle is shown and described. Upfiring speakers simulate overhead speakers by using a ceiling to reflect sound toward the listener from above the listener's head. However, in rooms with high ceilings, such reflection is not practical. The redirecting baffle is spaced apart from the upfiring speakers along a height axis and is oriented downward so that a surface normal to the baffle is neither parallel to nor perpendicular to the floor. By adjusting the angle of orientation, the location at which the reflected sound quality is best can be adjusted toward or away from the upfiring speakers. The system is particularly useful for in-store displays as many stores have ceiling heights that make sound reflection from an upfiring speaker impractical.

28 Claims, 6 Drawing Sheets

UPFIRING SPEAKER SYSTEM WITH REDIRECTING BAFFLE

TECHNICAL FIELD

This disclosure relates generally to sound systems featuring upfiring speakers, and more specifically, to those including a redirecting baffle.

BACKGROUND

Advances in audio technology have led to the development of home theater sound systems that seek to replicate the experience of watching a movie in a theatre. In such systems, sound is propagated in all three dimensions, with speakers in front of, behind, and overhead of the listener. Home systems have been developed to replicate the theater experience, and some systems include overhead speakers. However, overhead speakers can be unwieldy or unattractive in the home. In certain cases, ceilings are too high to make their use practical.

To simulate the use of overhead speakes, "reflected sound" or "upfiring" speakers have been developed. Upfiring speakers are located at or near ground level and include upfiring drivers, i.e., drivers facing straight up (sometimes referred to as "top firing") or at an upward facing angle relative to a horizontal plane. In certain cases, the median axis of the speaker driver is perpendicular to the floor and/or the ceiling. However, in other cases the median axis is oriented at an angle that intersects the ceiling at a desired location. In some cases, the upfiring speakers are provided in a "soundbar" which is a lengthwise array of speakers.

The sound from the upfiring speakers reflects off of a desired location on the ceiling and toward the listener, which simulates overhead speakers. However, in some homes the ceilings are prohibitively high to make such reflection practical. Similarly, many retail stores also have very high ceilings, well over twenty feet from the floor. In some cases, the ceiling is not sufficiently reflective to reflect sound to the listener without a degradation in quality. Also, it may be desirable to create surround-sound in outdoor environments where there is no ceiling. As a result, potential buyers cannot hear a demonstration of how the upfiring speakers are intended to be used.

SUMMARY

In accordance with a first aspect of the present disclosure, an audio-visual system is provided in an area with a floor and comprises an audio-visual display and a speaker having a median axis oriented at an upward angle of inclination relative to a horizontal plane. The audio-visual display has a top and a bottom spaced apart along a height axis. A redirecting baffle extends above the top surface of the audio-visual display along the height axis and faces downward to receive and redirect soundwaves from the speaker. In certain examples, the median axis is oriented at an upward angle of inclination from about 60 degrees to about 120 degrees relative to the horizontal plane. In the same or other examples, the redirecting baffle is oriented at an upward angle of inclination from about 10 degrees to about 50 degrees relative to the horizontal plane. In the same or other examples, the redirecting baffle is formed from a transparent rigid material, which in certain embodiments, is a transparent acrylic polymer. In certain examples, the speaker is provided as part of a soundbar comprising a linear array of speakers, each having drivers with respective median axes oriented at upward angles relative to the horizontal plane.

In accordance with second aspect of the present disclosure, a sound system is provided which comprises a speaker and a redirecting baffle. The speaker has driver with a median axis oriented upward relative to the horizontal plane, and the redirecting baffle is located above the speaker along a height axis and oriented at an upward angle relative to the horizontal plane to receive soundwaves from the speaker. In the same or other examples, the median axis is oriented at an angle of from about 60° to about 120° relative to the horizontal plane. In the same or other examples, the redirecting baffle is oriented at an upward angle of inclination of no more than 60° relative to the horizontal plane. In accordance with further aspects, the sound system is part of a sound system display and is mounted on a display comprising a base and a vertical panel.

DETAILED DESCRIPTION

As discussed below, the present disclosure provides sound systems that include one or more upfiring speakers with a sound reflective baffle. The sound systems may be used in indoor or outdoor areas as well as in areas that do not have ceilings (such unenclosed areas outdoors). When referring to such areas herein, the term "floor" will be used. As used herein, the term "floor" refers to the lower surface of an area on which people generally walk and/or on which furniture sits and includes the earth, temporary or permanent surfaces laid on the earth, or elevated surfaces on which people walk (such as an upper story floor). The term "area" may be used to refer to designated locations indoors or outdoors and includes without limitation rooms, warehouses, stores, fields, parking lots, other designated outdoor locations, gymnasiums, and convention centers to name but a few. As used herein, the term "upfiring speaker" refers to a speaker with an upfiring driver. The term "speaker" means one or more drivers in a unitary enclosure. Speakers may include upfiring, front-firing and/or side-firing drivers. The term "driver" means a single electroacoustic transducer that produces sound in response to an electrical audio input signal. Typical speaker drivers include cone, horn, and ribbon transducer speaker drivers. The driver includes a median axis which is a reference axis used to gauge the spatial distribution of sound from the driver. If the median axis points upward (i.e., has a positive angle relative to a horizontal plane such as would be defined by a floor), the speaker is said to be "upfiring." In a limiting case, the positive angle is ninety degrees relative to the horizontal plane, in which case the upfiring speaker is said to also be "top firing." One commercially available audio platform that is designed to utilize upfiring speakers is the Dolby Atmos® platform.

Front-firing and side-firing drivers project their sound in different (but sometimes overlapping) directions in the horizontal plane. Their median axes are substantially parallel to the horizontal plane or close enough to parallel that they could not intersect the ceiling of the room in which the speakers are placed.

Figure 7A:
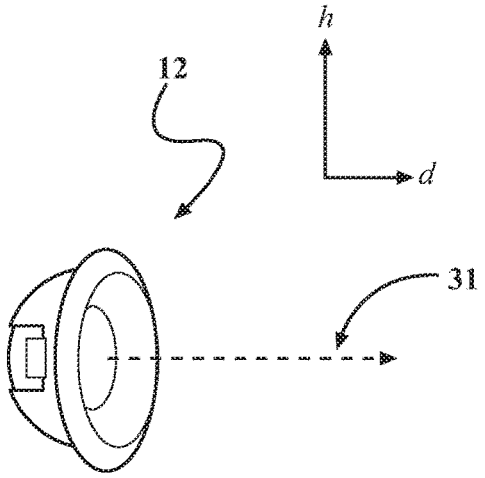
FIG. 7A is a side elevational view of a front firing speaker driver.
Figure 7B:
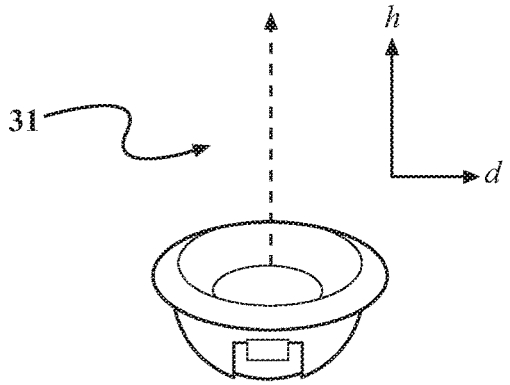
FIG. 7B is a side elevational view of an upfiring speaker driver.
Figure 7C:
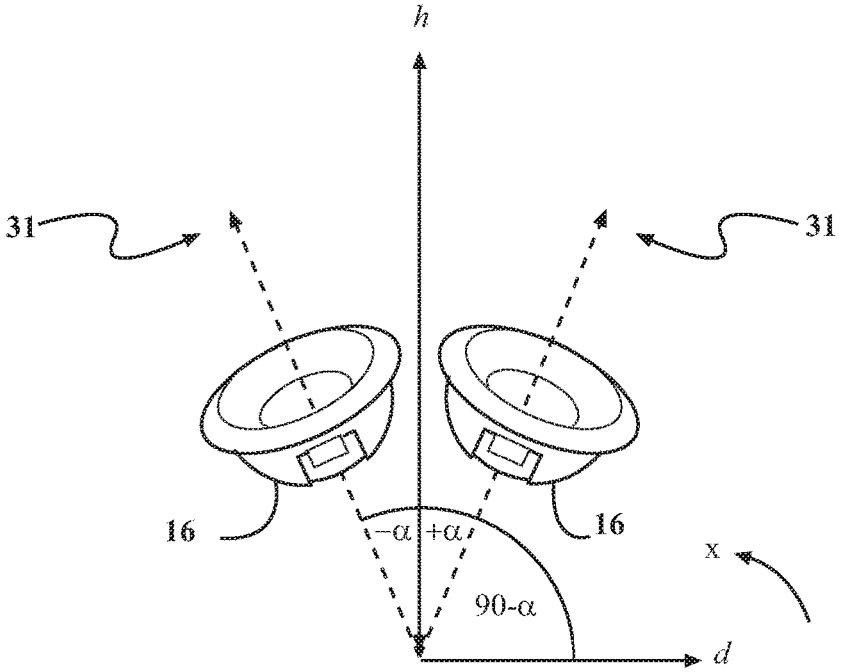
FIG. 7C is a side elevational view of an upfiring speaker driver showing various angles of inclination relative to a horizontal plane defined by the length (l) and depth (d) axes of a speaker system.

Referring to FIG. 7A, a front firing speaker driver 12 is shown. Median axis 31 is an axis of symmetry running through the driver and is parallel to the depth axis d, which is typically defined by the floor or ceiling of the room in which a speaker including driver 12 is placed. In contrast, speaker driver 14 in FIG. 7B is an upfiring speaker driver that is also top firing, with its median axis oriented perpendicularly to the horizontal plane (and the length l and depth d axes that define the horizontal plane) and parallel to the height axis h. FIG. 7C shows an upfiring speaker driver 16 with a median axis 31 that is angled relative to the horizontal plane defined by the length l and depth d axis. The angle of inclination of median axis 31 relative to the horizontal plane is $90°+\alpha$, with the angle of tilt of median axis 31 relative to the vertical plane defined by the height h and length l axes being $+\alpha$ degrees. FIG. 7C shows two upfiring orientations relative to the top firing orientation in which the driver 16 is oriented at angles ranging from $+\alpha$ to $-\alpha$ relative to the vertical plane defined by the length l and height h axes. The length l axis is not visible in FIGS. 7A-7C but would run perpendicular to the page. In certain examples, herein, a is preferably from about −30° to about +30°, more preferably from about −25° to about +25°, and still more preferably from about −20° to about +20° relative to the vertical plane defined by the height h and length l axis, making $90°-\alpha$ from about 120° to about 60°, preferably from about 115° to about 65°, and more preferably from about 100° to about 70° relative to the horizontal plane defined by the length l and depth d axes.

Figure 1:
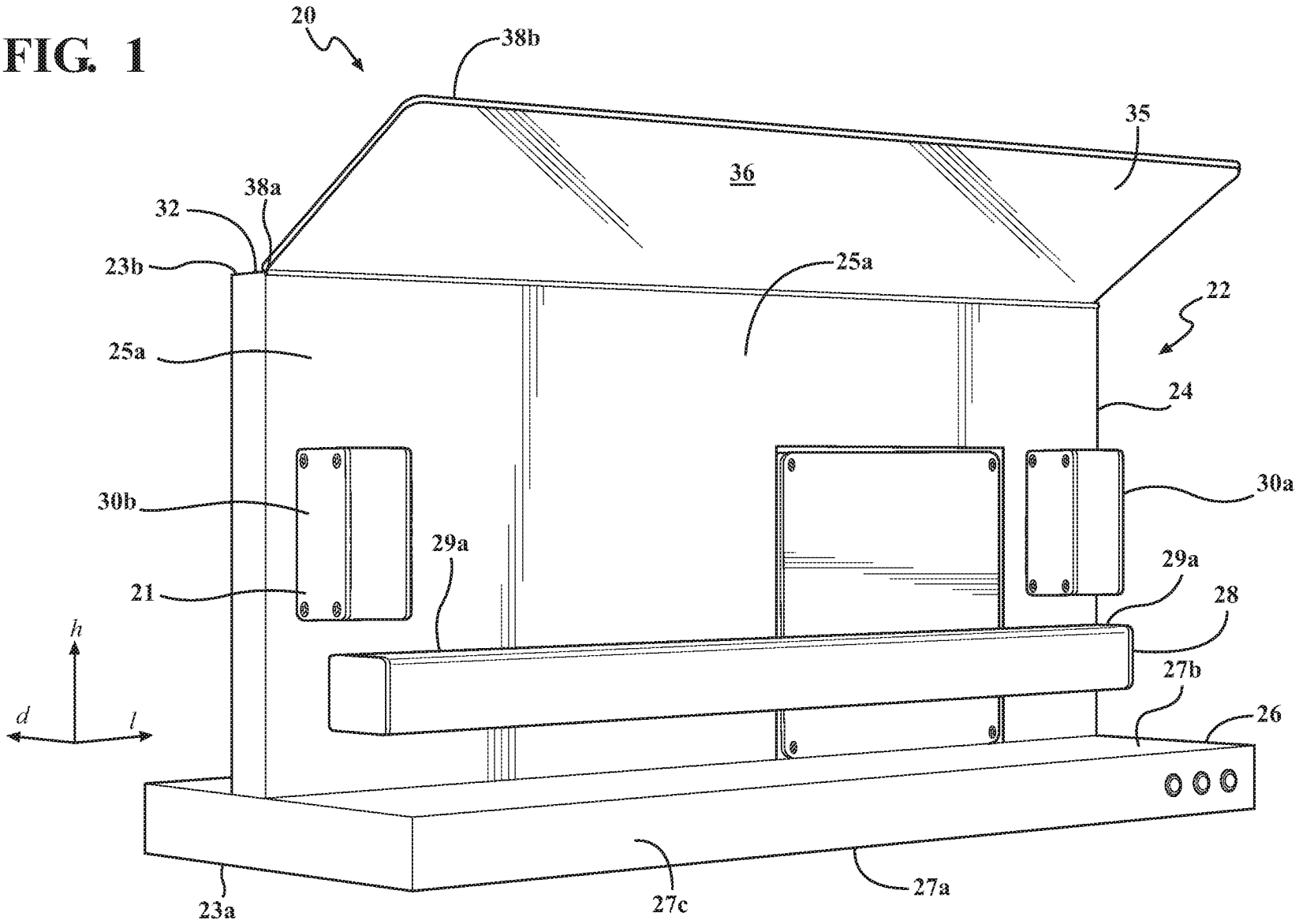
FIG. 1 is a perspective view of a sound system display in which a sound system with an upfiring speaker includes a redirecting baffle, in accordance with the present disclosure.

Referring to FIG. 1, a sound system display 20 is depicted. The sound system display 20 is one that would typically be found in a retail store to demonstrate the use of a sound system. Sound system display 20 includes a sound system 21 mounted on a display 22. Sound system 21 includes a sound bar 28 and two front firing speakers 30*a* and 30*b*. Soundbar 28 includes one or more upfiring speaker drivers 29*a*-29*n* spaced apart along a length l axis. The front firing speakers 30*a* and 30*b* are spaced apart from the soundbar 28 along a height h axis. The front firing speakers 30*a* and 30*b* are spaced apart from one another along a length l axis. Alternatively, or in addition, separate upfiring speakers not included in a soundbar may be provided.

Display 22 includes a base 26 and a vertical panel 24. Display 22 has a first end 23*a* defined by base 26 and a second end 23*b* defined by vertical panel 24 which are spaced apart from one another along the height h axis. The vertical panel 24 is secured to the base 26 so as to be supported by and oriented perpendicularly to base 26. Vertical panel 24 includes opposing major sides 25*a* and 25*b* (not visible in FIG. 1). The front firing speakers 30*a* and 30*b* and the soundbar 28 are attached to side 25*a* which is the side intended to face the listener, which in a retail environment, may be a prospective customer.

Base 26 has a lower surface 27*a* and an upper surface 27*b* which are spaced apart from one another along the height h axis. Base 26 also has a front surface 27*c* and a rear surface 27*d* spaced apart from one another along the depth d axis. The lower surface 27*a* would typically rest on a floor, a shelf, or a table. In certain examples, the display 22 is positioned so that the base 26 is at or near eye level of customers.

Redirecting baffle 35 is attached to an upper surface 32 of the vertical panel 24. Upper surface 32 of the vertical panel 24 is spaced apart from the soundbar 28 along the height h axis. Redirecting baffle 35 is a rigid panel made of a material that is not acoustically transparent. Redirecting baffle 35 has a downward facing face 36 (i.e., a vector perpendicular to face 36 intersects a horizontal plane (the lxd plane) positioned beneath the redirecting baffle 35 along the height h axis). Redirecting baffle 35 receives soundwaves from the upfiring speaker drivers 29*a*-29*n* in soundbar 28 and reflects the soundwaves toward a listener standing in front of display 22, as illustrated in FIG. 46.

In certain examples, the redirecting baffle 35 is formed from a rigid polymeric material. In the same or other examples, the rigid polymeric material is an acrylic polymeric material. In the same or other examples, the acrylic material is a poly alkyl acrylate, and preferably, a poly alkyl alkylacrylate, such as polymethylmethacrylate (PMMA). In certain examples, the redirecting baffle 35 is transparent. In the same or other examples, the redirecting baffle has words and/or symbols that may be painted or etched into it which relate to the sound system 21. In one preferred example, redirecting baffle 35 is a transparent, acrylic baffle with words and/or symbols etched into it which describe characteristics of the sound system 21.

Figure 3:
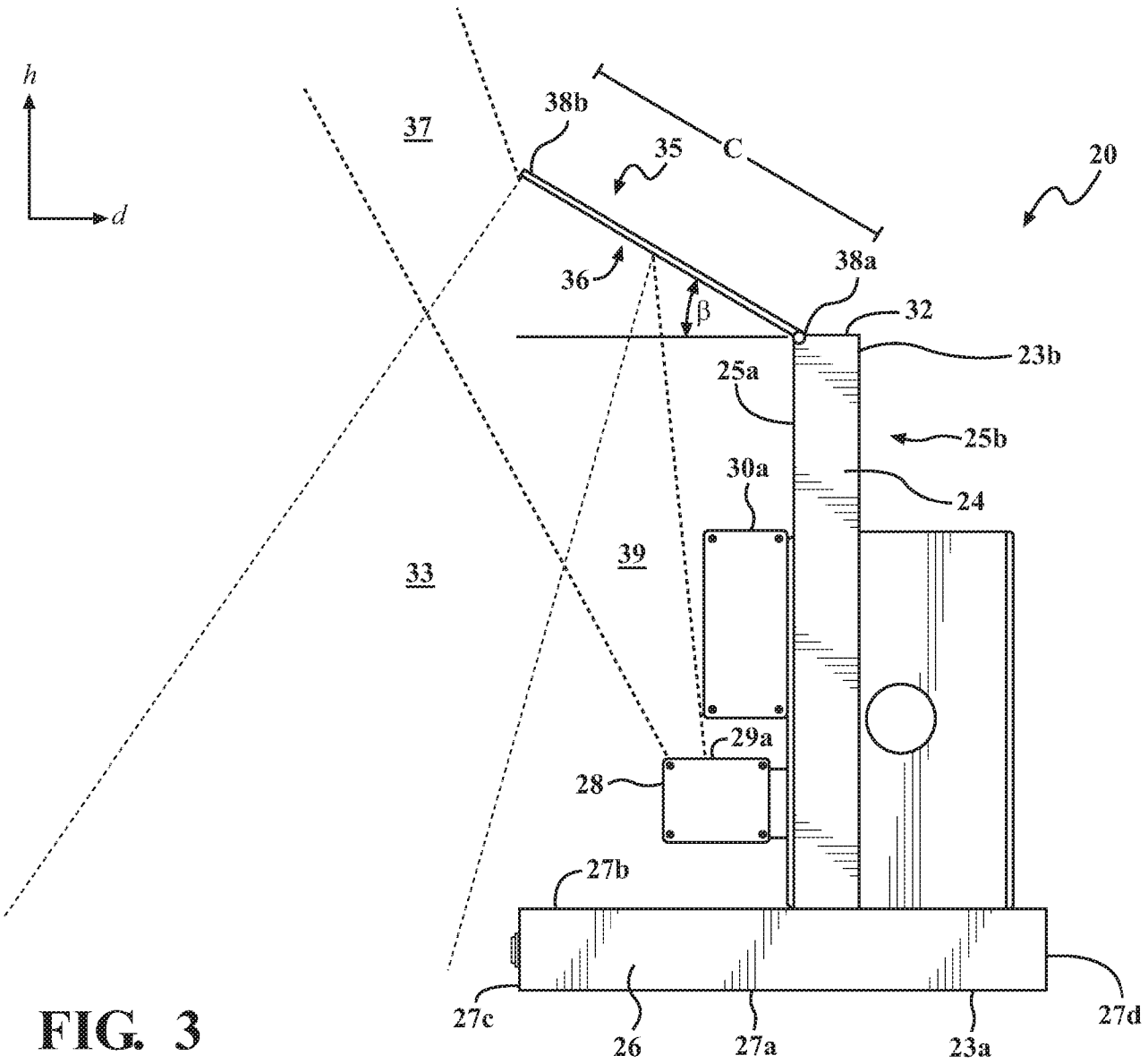
FIG. 3 is a side elevational view of the sound system display of FIG. 1.
Figure 4:
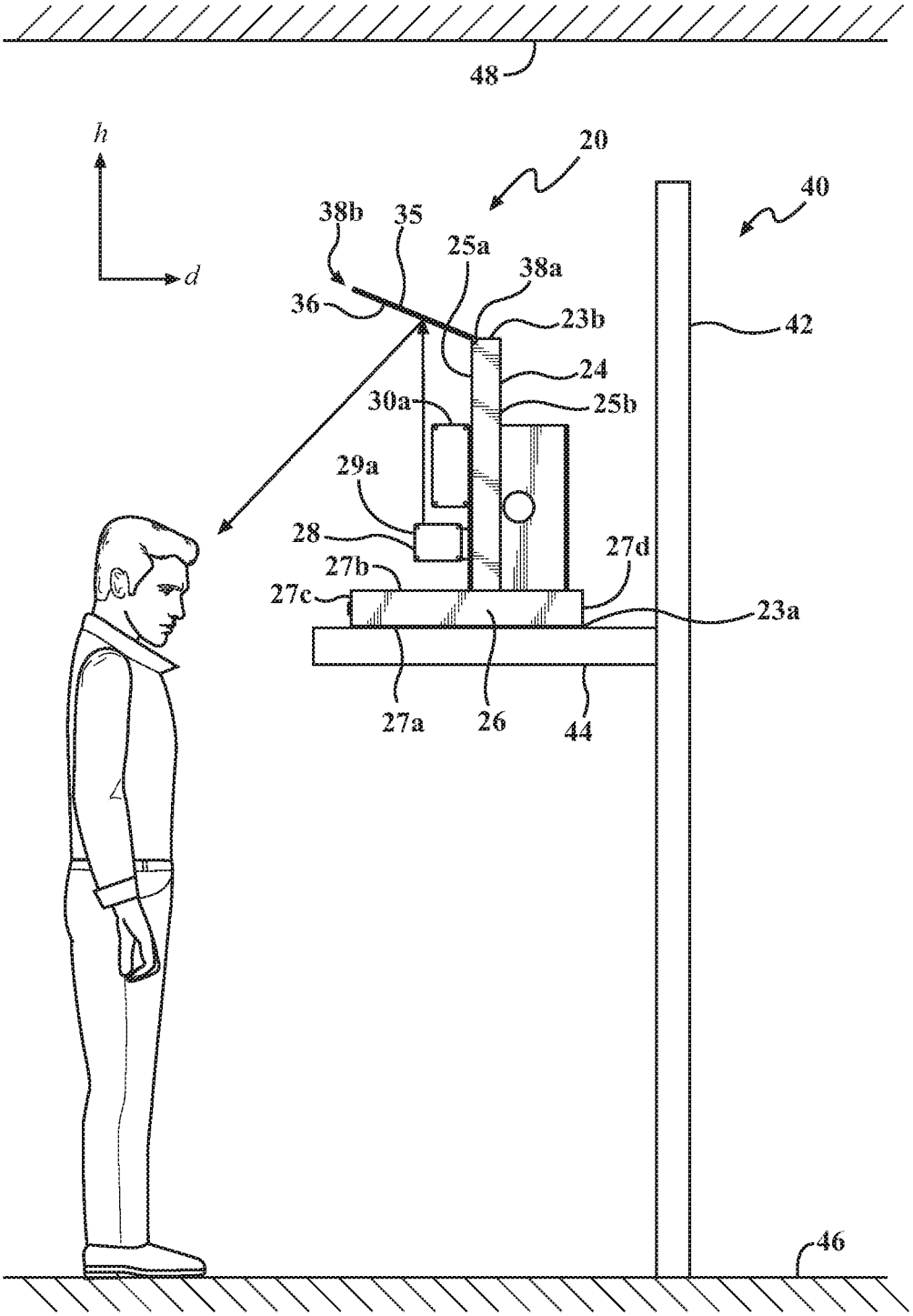
FIG. 4 is a side elevational view of the sound system display of FIG. 1 placed in a room with a ceiling higher than the redirecting baffle.

As best seen in FIG. 3, the redirecting baffle 35 is preferably oriented at a positive angle of inclination β above the plane defined by the upper surface 32 of the vertical panel 24 of the display 22. The plane is a horizontal plane parallel to the plane defined by the length l and depth d axes and which intersects proximal baffle end 38*a*. The angle of inclination β is preferably set to ensure that the sound from soundbar 28 is reflected to the listener standing in front of the sound system display 20. FIG. 3 depicts an exemplary transmitted soundwave distribution 39 from drivers 29*a*-29*n* and an exemplary reflected soundwave distribution 33 from redirecting baffle 35. Soundwave distribution 37 is transmitted from soundbar 28 but is not reflected from redirecting baffle 35. The preferred angle of inclination β will depend on the height of the baffle 35 relative to the listener and the angle of inclination of the median axes of upfiring speaker drivers 29*a*-29*n*. In one example in which the baffle proximal end 38*a* is from about seven to about nine feet from the floor along the height h axis, the angle of inclination (upward tilt) β of the baffle 35 is preferably from about 10 degrees to about 60 degrees, more preferably from about 20 to about 40 degrees, and still more preferably from about 25 to about 35 degrees. The angle of inclination is said to be "upward" because the distal end 38*b* of the redirecting baffle 35 is higher than the proximal end 38*a* of the redirecting baffle 35 along the height h axis. The distal end 38*b* of the redirecting baffle is positioned between the listener and the proximal baffle end 38*a* along the depth d axis. In this configuration, the listener is expected to stand (not sit) in front of display 22. This configuration is illustrated in FIG. 4. In FIG. 4 the base 26 is near the eye level of the listener, which may range typically from about five to about seven feet from the floor 46 along the height axis h. The proximal end 38*a* of the redirecting baffle 35 is located from about ten (10) to about 30 inches from the bottom surface 27*a* of the display base 26 along the height h axis.

The baffle 35 is preferably sized so that the projected distance along the depth d axis from the proximal end 38*a* to the distal end 38*b* does not extend beyond the forward surface 27*c* of the display base 26. In certain examples, the hypotenuse length of the baffle 35 (i.e., the linear distance c from proximal end 38*a* to distal end 38*b* along baffle surface when viewing the baffle 35 in a direction parallel to the length l axis as shown in FIGS. 3 and 4) is from about eight (8) to about twelve (12) inches, preferably from about nine (9) to about eleven (11) inches, and more preferably from about 9.5 to about 10.5 inches. As indicated in FIG. 4, in certain preferred examples, the sound system display 20 rests on shelf 44 of shelving system 40, wherein the shelf 44 is supported by a vertical support panel 42. The vertical support panel 42 is supported directly or indirectly by the floor 46 which is spaced apart from the ceiling 48 along the height h axis.

At a given height of the proximal end 38*a* of redirecting baffle 35 from the floor 46 along the height h axis, the use of an existing shelfing system 40 allows the height of the vertical panel 24 along the height h axis to be reduced relative to what would be required if the display base 26 sat on the floor. The length of the redirecting baffle 35 along the length l axis is preferably no less than the distance between the outermost drivers 29*a* and 29*n* of the baffle 35 and is probably long enough to capture the full distribution of soundwaves from all of the drivers 29*a*-29*n* along the length l axis. In a preferred method of use, as shown in FIG. 4, the listener stands in front of the front surface 27*c* of the base 26 along the depth d axis and between the ends of the soundbar 28 and the baffle 35 along the length l axis. In certain examples, the baffle length along the length l axis is from about 20 to about 60 inches, preferably from about 30 to about 50 inches, and more preferably from about 35 to about 45 inches.

In accordance with a method of use, a sound signal is provided (e.g., from a stereo receiver, mp3 player, etc.) to the sound system 21. Soundwaves from the upfiring drivers 29*a*-29*n* of the soundbar 28 are transmitted to and reflected from the redirecting baffle 35 and received by the listener. The soundwaves are reflected from the baffle 35, which is above the listener's head along the height h axis, and thus, simulate the experience of overhead speakers.

In one example, the baffle 35 has words and/or symbols which describe characteristics of the sound system 21, such as company names, trade names, trademarks, electrical specifications, acoustic specifications, prices, warranty terms, etc. In certain preferred examples, the baffle 35 is transparent or translucent and has the words and/or symbols etched into downward facing surface 36.

Sound signals are also concurrently provided to front firing speakers 30*a* and 30*b*, thereby giving the listener the experience of having sound come from in front of and overhead of him or her. In a modified example, front firing speakers 30*a* and 30*b* or an additional pair of front firing speakers may be positioned behind the listener to provide sound from in front of, overhead of, and behind the listener. In the same or other examples, side baffles angled inwardly toward the listener (i.e., oriented at an angle with respect to planes defined by the height h and depth d axes) may redirect sound from the front firing speakers 30*a* and 30*b*. This would allow the listener to receive more sound from the front firing speakers despite standing relatively close to them. The side baffles would preferably comprise materials similar to those of the redirecting baffle 35.

Figure 5:
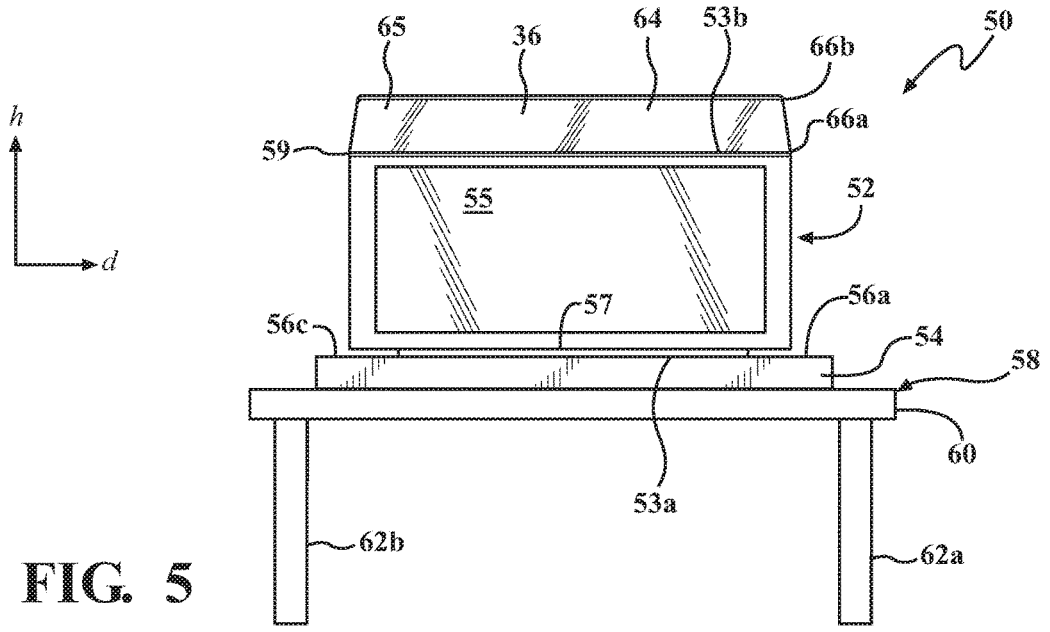
FIG. 5 is a front elevational view of an audio-visual system with an upfiring speaker and a redirecting baffle.
Figure 6:
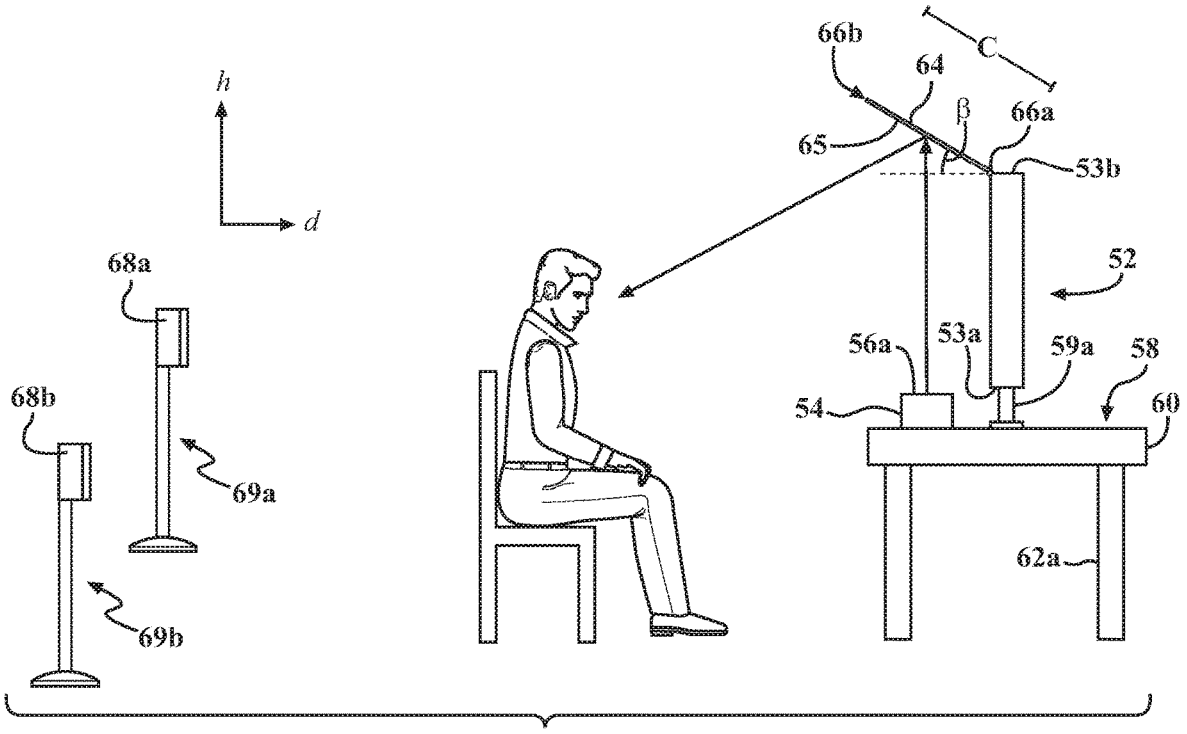
FIG. 6 is a side elevational view of a home theater system comprising the audio-visual system of FIG. 5.

Sound systems with redirecting baffles may also be used with audio-visual systems and attached directly to the audio-visual display, or mounted above the audio-visual display. Such systems are especially desirable in homes or other locations with high ceilings that are not suitable for reflecting sound from upfiring speakers. An example of such an audio-visual system 50 is provided in FIGS. 5 and 6. In accordance with the example, audio-visual system 50 comprises an audio-visual display 52 and a sound system 51 (reference numeral not shown). Sound system 51 comprises a soundbar 54, and front firing speakers 68*a* and 68*b*. The audio-visual display 52 comprises a screen 55 located in a housing 57 that frames the screen 55. Display 52 has first end 53*a* and second end 53*b* spaced apart along the height h axis. In some examples, the first end 53*a* is spaced apart from the soundbar 54 along the height h axis. The audio-visual display 52 and soundbar 54 preferably are elevated on a support system to allow the upfiring speaker sound waves to be reflected off redirecting baffle 64 toward the listener from above the listener's head. In the example of FIGS. 5 and 6, the support system is a table 58. Table 58 comprises horizontal support member 60 and vertical supports (e.g., legs) 62*a* and 62*b*. Audio-visual display 52 comprises vertical supports 59*a* and 59*b* (not visible in figures) which rest on the table's horizontal support member 60 and are attached to a lower surface of the audio-visual display housing 57. Soundbar 54 comprises a plurality of upfiring speaker drivers 56*a*-56*n* spaced apart along the length l axis. Soundbar 54 is preferably spaced apart from the audio-visual display 52 by at least a few inches along the depth d axis to ensure that the audio-visual display 52 is not blocking soundwaves from reaching redirecting baffle 64.

Redirecting baffle 64 is similar to redirecting baffle 35. In certain examples, the baffle 62 is transparent. In the same or other examples, baffle 62 comprises a transparent acrylic material. In the same or other examples, the acrylic material is a poly alkyl acrylate, and preferably a poly alkyl alkacrylate such as polymethyl methacrylate (PMMA). The redirecting baffle 64 has a proximal end 66*a* and a distal end 66*b* which define the baffle's hypotenuse length c (which is not parallel to the height h axis).

As in the example of FIGS. 1-4, redirecting baffle 64 extends above the top surface 59 of the audio-visual display 52 along the height h axis when moving along baffle 64 along the depth d axis away from audio-visual display 52. Redirecting baffle 64 is oriented at a positive angle of inclination β relative to the plane defined by the length l and depth d axes such that a surface normal to baffle surface 65 intersects the lxd plane. The angle of inclination (upward tilt) β of the baffle 64 is preferably from about 10 degrees to about 60 degrees, more preferably from about 20 to about 40 degrees, and still more preferably from about 25 to about 35 degrees. The angle of inclination β is preferably set to ensure that a maximum amount of sound reflected from the baffle 64 reaches the listener. The proximal end 66*a* of the baffle 64 is preferably from about 4 to about 6 feet, more preferably from about 4.5 to about 5.5 feet, and still more preferably about 5 feet from the floor along the height h axis. The redirecting baffle 64 is preferably attached to a top surface 59 of the audio-visual display housing 57. A bracket assembly may be used to make the attachment or the baffle may be directly attached to top surface 59. Alternatively, a separate support may be provided to support the redirecting baffle 64 over the audio-visual display 52 so that attachment to the display 52 is avoided. Such a separate support may also be provided with an adjustable height such as by using telescoping legs. In one example, the angle of inclination of the redirecting baffle 64 may be user adjustable. For example, the baffle 64 may be attached to a cross-member that is rotatable to pivot the baffle 64.

The dimensions of the redirecting baffle 64 are preferably selected to ensure a length along the length l axis that is at least as long as the distance between the end-most upfiring speaker drivers 56*a*-56*n*. In certain examples, the hypotenuse length c of the baffle 35 (i.e., the linear distance from proximal end 66*a* to distal end 66*b* along baffle surface 65 when viewing the baffle in a direction parallel to the length l axis, as shown in FIG. 6) is set to ensure that the baffle 64 does not protrude in front of the horizontal support member 60 along the depth d axis and so that when attached to the audio-visual display 52, baffle 64 does not cause the audio-visual display 52 to fall over. In certain examples, the redirecting baffle 64 hypotenuse length c is from about eight (8) to about twelve (12) inches, preferably from about nine (9) to about eleven (11) inches, and more preferably from about 9.5 to about 10.5 inches.

Front firing speakers 68*a* and 68*b* are preferably placed behind the listener and are elevated on stands 69*a* and 69*b*. The front firing speakers 68*a* and 68*b* are preferably turned toward the listener thereby providing the listener with sound reflected from above his or her head (from soundbar 54) and behind and on both sides of him or her (along the length l axis) from front firing speakers 68*a* and 68*b*.

EXAMPLE

Figure 2:
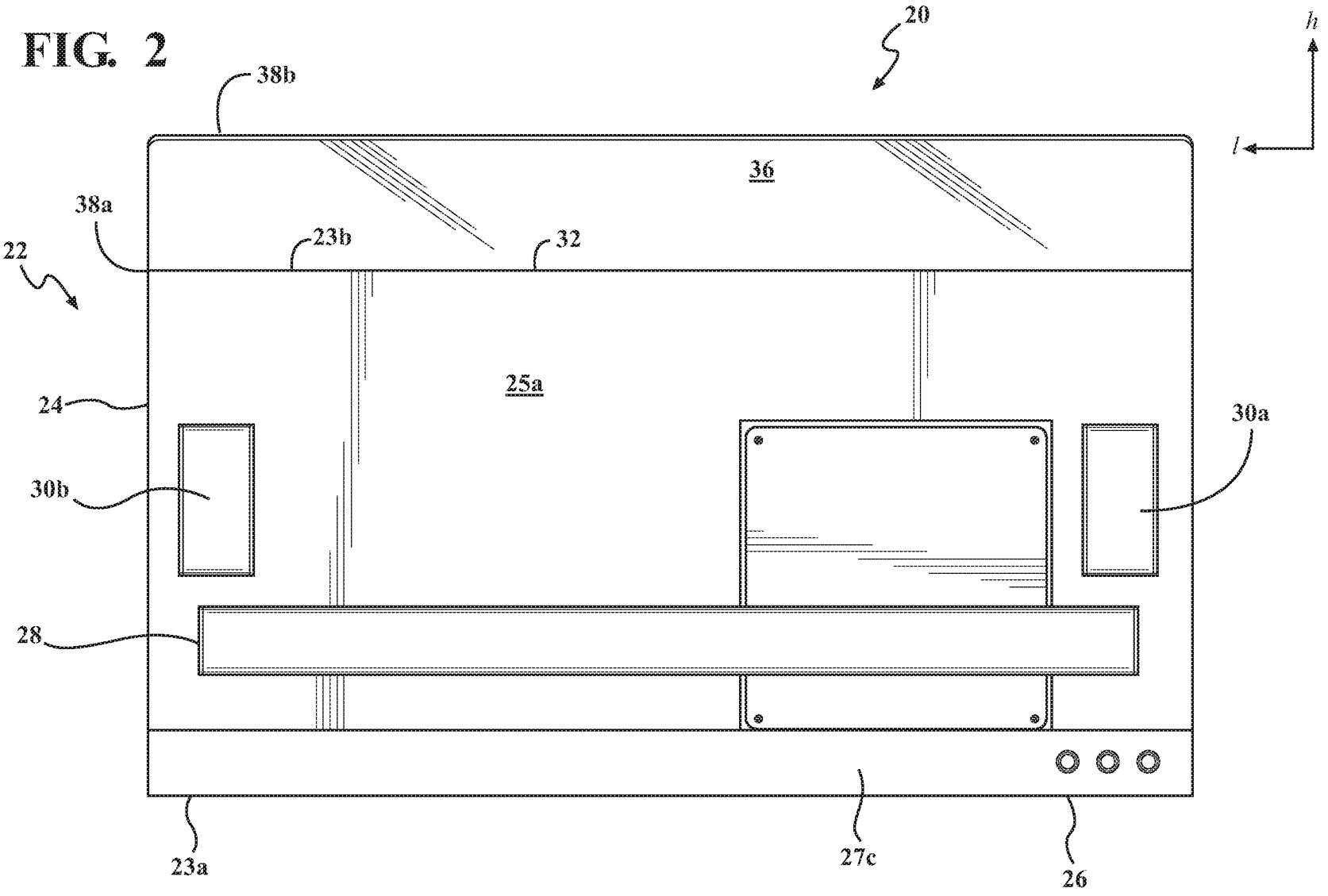
FIG. 2 is a front elevational view of the sound system display of FIG. 1.

A sound system 20 display is provided as illustrated in FIGS. 1-3. Display 22 includes a base 26 that is 40 inches long, 16 inches deep, and 2.5 inches high. A Dolby Atmos® soundbar is mounted on vertical panel 24 such that its upward firing drivers are inward of the front firing speakers 30*a* and 30*b* along the length l axis. Top surface 32 of vertical panel 24 is 20 inches from the bottom surface 27*a* of the base 26. The angle of inclination of the median axes of upward firing drivers 29*a*-29*n* in soundbar 28 is 20 degrees (i.e., 20 degrees from the vertical plane defined by the length l and height h axes). Redirecting baffle 35 has a hypotenuse length c of 10 inches and an angle of inclination β of 30 degrees. The vertical panel 24 of the display 22 is positioned on the base 26 along the depth d axis so that the distal end 38*b* of the redirecting baffle 35 does not extend beyond the front surface 27*c* of the display base 26. The depth d axis projection of baffle 35 is 10 inches×cos(30°) =8.7 inches. Thus, the forward facing surface 25*a* of the vertical panel 24 is preferably spaced apart from the forward facing surface 27*c* of the base 26 by a distance greater than 8.7 inches. When the soundbar 28 is connected to a source of sound, its drivers transmit soundwaves to the baffle 35 which are reflected toward the listener.

What is claimed is:

1. An audio-visual system in an area having a floor defining a horizontal plane, the audio-visual system comprising:

a visual display having a top and a bottom spaced apart along a height axis;

a speaker comprising a driver having a median axis oriented at an upward angle of inclination relative to the horizontal plane; and a redirecting baffle extending above the top surface of the visual display along the height axis and facing downward to receive and redirect soundwaves from the speaker, wherein the speaker and the redirecting baffle are spaced apart from one another along the height axis, wherein the upward angle of inclination of the driver's median axis is from about 70° to about 100° relative to the horizontal plane, and the redirecting baffle is oriented at an upward angle of inclination from about 10° to about 60° relative to the horizontal plane.

2. The audio-visual system of claim 1, wherein the redirecting baffle is attached to the top surface of the visual display.

3. The audio-visual system of claim 1, wherein the redirecting baffle is clear.

4. The audio-visual system of claim 1, wherein the redirecting baffle has a surface facing toward the floor, and the surface has words and/or symbols on it.

5. The audio-visual system of claim 1, wherein the redirecting baffle is formed from an acrylic polymer.

6. The audio-visual system of claim 1, further comprising a sound bar having a length along a length axis, wherein the soundbar comprises a plurality of drivers spaced apart along the length axis and having respective median axes oriented at non-orthogonal angles relative to the horizontal plane, and the plurality of drivers comprises the driver having a median axis oriented at an upward angle of inclination relative to the horizontal plane.

7. A method of using the audio-visual system of claim 1, comprising placing the audio-visual system in the area and transmitting sound waves from the driver, wherein the area has a ceiling spaced apart from the floor along the height axis, and the ceiling is at least 20 feet higher than the redirecting baffle along the height axis.

8. The method of claim 1, wherein the area has no ceiling.

9. A sound system, comprising:

a speaker comprising a driver with a median axis oriented at an upward angle of inclination relative to a horizontal plane;

a redirecting baffle located above the speaker along a height axis and oriented at an upward angle of inclination relative to the horizontal plane to receive and redirect soundwaves from the speaker, wherein the upward angle of inclination of the driver's median axis is from about 70° to about 100° relative to the horizontal plane, and the redirecting baffle is oriented at an upward angle of inclination from about 10° to about 60° relative to the horizontal plane.

10. A surround sound system comprising:

the sound system of claim 9, wherein the speaker comprising a driver with a median axis oriented at an upward angle of inclination relative to a horizontal plane is an upfiring speaker; and a front firing speaker facing the upfiring speaker and spaced apart from the upfiring speaker in a direction parallel to the horizontal plane.

11. The sound system of claim 9, wherein the redirecting baffle is attached to the top surface of the audio-visual display.

12. The sound system of claim 9, wherein the redirecting baffle is clear.

13. The sound system of claim 9, wherein the redirecting baffle has a surface facing toward the floor, and the surface has words and/or symbols on it.

14. The sound system of claim 9, wherein the redirecting baffle is formed from an acrylic polymer.

15. The sound system of claim 9, further comprising a sound bar having a length along a length axis, wherein the soundbar comprises a plurality of drivers paced apart along the length axis and oriented at non-orthogonal angles relative to the horizontal plane, and the plurality of drivers comprises the driver oriented at an upward angle of inclination relative to the horizontal plane.

16. A sound system display, comprising:

the sound system of claim 9;

a vertical panel and a base, wherein the redirecting baffle and the speaker are attached to the vertical panel.

17. The sound system display of claim 16, wherein the redirecting baffle includes words and/or symbols.

18. The sound system display of claim 16, further comprising a sound bar having a length along a length axis, wherein the soundbar comprises a plurality of drivers spaced apart along the length axis and having respective median axes oriented at non-orthogonal angles relative to the horizontal plane, and the plurality of drivers comprises the driver having a median axis oriented at an upward angle of inclination relative to the horizontal plane.

19. The sound system display of claim 16, wherein the speaker is a first speaker, and the sound system further comprises second and third speakers spaced apart from one another along a length axis and each having a driver with a median axis oriented parallel to the horizontal plane.

20. A method of operating a sound system, comprising:

placing the sound system display of claim 16 in an area having a floor defining the horizontal plane; and transmitting sound waves to the driver.

21. The method of claim 20, wherein the area has a ceiling, and the ceiling is spaced apart from the redirecting baffle by at least twenty feet along the height axis.

22. The method of claim 20, wherein the area has no ceiling.

23. The method of claim 20, wherein the redirecting baffle is spaced apart from the floor along the height axis by between about seven and about nine feet.

24. The method of claim 20, further comprising deflecting sound waves received from the driver off of the baffle and to a listener standing proximate the sound system display.

25. The method of claim 20, wherein the baffle is clear and has words and/or symbols etched thereon.

26. The method of claim 20, wherein the redirecting baffle projects a first distance along a depth axis from the vertical panel, the base projects a second distance along the depth axis from the vertical panel, and the first distance is no greater than the second distance.

27. The method of claim 20, wherein the sound system further comprises a sound bar having a length along a width axis, wherein the soundbar comprises a plurality of drivers spaced apart along the width axis and oriented at non-orthogonal angles relative to the horizontal plane, and the plurality of drivers comprises the driver oriented upward relative to the horizontal plane.

28. The method of claim 20, further comprising projecting sound waves from the driver to a listener, wherein the step of projecting sound waves from the driver to a listener further comprises reflecting the soundwaves off of the redirecting baffle at a baffle location above the listener's head along the height axis.

* * * * *